United States Patent [19]

Rudnick

[11] 4,409,089

[45] Oct. 11, 1983

[54] COAL LIQUEFACTION AND RESID PROCESSING WITH LIGNIN

[75] Inventor: Leslie R. Rudnick, Trenton, N.J.

[73] Assignee: Mobil Oil Corporation, New York, N.Y.

[21] Appl. No.: 325,896

[22] Filed: Nov. 30, 1981

Related U.S. Application Data

[63] Continuation-in-part of Ser. No. 178,214, Aug. 14, 1980, Pat. No. 4,303,496.

[51] Int. Cl.[3] ..... C10G 1/00; C10G 1/06; C10G 47/00; C10G 47/02

[52] U.S. Cl. ..... 208/8 LE; 208/8 R; 208/10; 208/107; 208/108; 208/112; 208/44; 208/89

[58] Field of Search ..... 208/8 R, 8 LE, 10, 107, 208/108, 112, 48 AA; 201/21

[56] References Cited

U.S. PATENT DOCUMENTS

| | | | |
|---|---|---|---|
| 2,591,496 | 4/1952 | Berl | 201/2.5 X |
| 3,151,057 | 9/1964 | Schuman et al. | 208/111 |
| 3,488,279 | 1/1970 | Schulman | 208/112 X |
| 3,775,296 | 11/1973 | Chernevok et al. | 208/108 |
| 3,844,937 | 10/1974 | Wolk | 208/108 |
| 4,152,250 | 5/1979 | Inooka et al. | 208/251 H |
| 4,176,051 | 11/1979 | Ternan et al. | 208/112 |
| 4,191,636 | 3/1980 | Fukiu et al. | 208/110 |
| 4,194,964 | 3/1980 | Chen et al. | 208/108 |
| 4,214,977 | 7/1980 | Rangovathan et al. | 208/108 |
| 4,220,518 | 9/1980 | Uchida et al. | 208/125 X |
| 4,247,384 | 1/1981 | Chen et al. | 208/8 LE |
| 4,252,634 | 2/1981 | Khulbe et al. | 208/107 X |
| 4,266,083 | 5/1981 | Huang | 208/10 X |
| 4,289,605 | 9/1981 | Bartholic | 208/113 |
| 4,299,685 | 11/1981 | Khulbe et al. | 208/112 X |

FOREIGN PATENT DOCUMENTS

| | | | |
|---|---|---|---|
| 173907 | 1/1922 | United Kingdom | 208/8 R |

*Primary Examiner*—Delbert E. Gantz
*Assistant Examiner*—William G. Wright
*Attorney, Agent, or Firm*—Alexander J. McKillop; Michael G. Gilman; Stanislaus Aksman

[57] ABSTRACT

In a coal liquefaction process, coal is admixed with about 1.0% to about 5.0% of lignin, based on the weight of the coal. In an alternative embodiment, feed of a resid processing method is admixed with 0.01% to 10% of lignin based on the weight of the coal.

13 Claims, 1 Drawing Figure

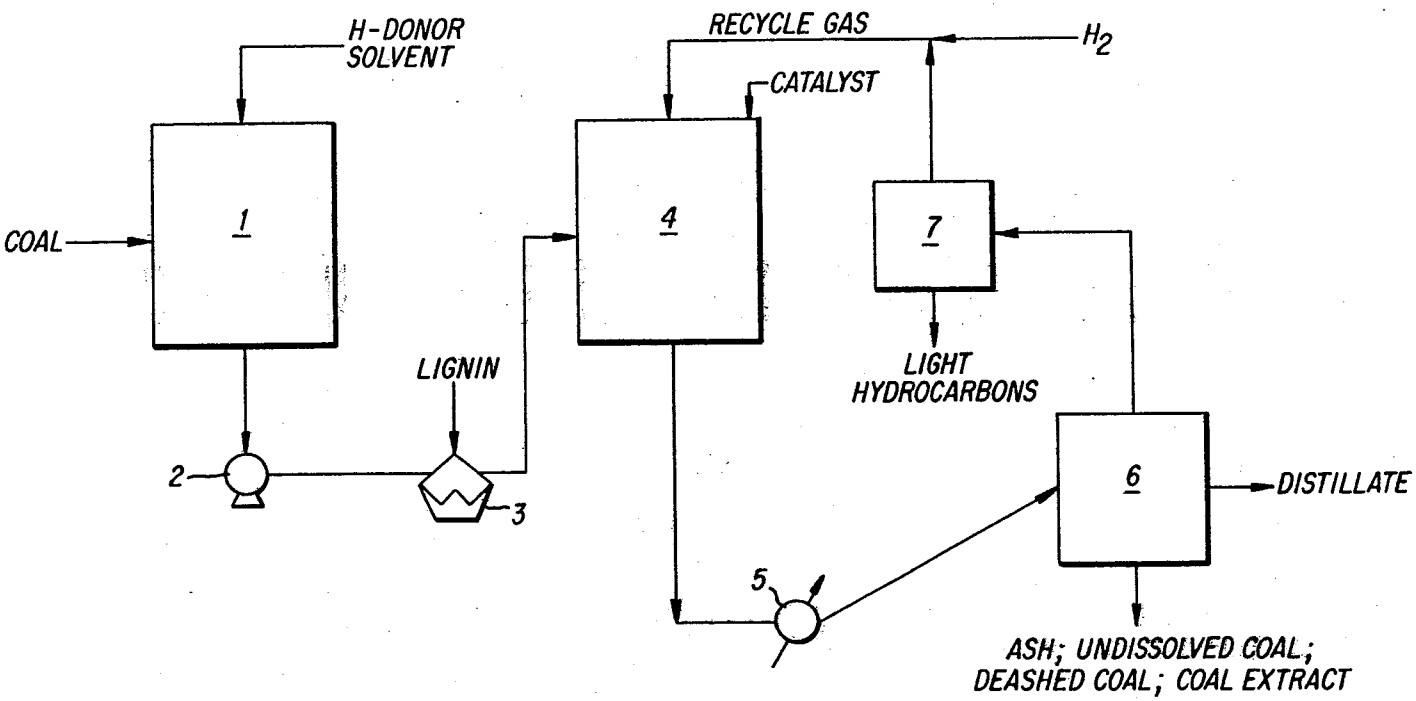
COAL
H-DONOR SOLVENT
1
2
LIGNIN
3
4
RECYCLE GAS
CATALYST
$H_2$
7
LIGHT HYDROCARBONS
5
6
DISTILLATE
ASH; UNDISSOLVED COAL; DEASHED COAL; COAL EXTRACT

COAL LIQUEFACTION AND RESID PROCESSING WITH LIGNIN

REFERENCE TO RELATED APPLICATION

This application is a continuation-in-part of a copending application, Ser. No. 178,214, filed Aug. 14, 1980, now U.S. Pat. No. 4,303,496.

BACKGROUND OF THE INVENTION

1. Field of the Invention

This invention relates to an improved method of coal liquefaction and resid upgrading. More particularly, this invention relates to the use of lignin in coal liquefaction and resid upgrading.

2. Description of Prior Art

In the last two decades there has been a resurgence of interest in coal as a source of synthetic crude oil. Accordingly, the art relating to the liquefaction of coal has developed significantly in the last two decades. However, most of the art relating to coal liquefaction relates to optimizing coal liquefaction processes from an engineering point of view. Until recently, optimization of coal liquefaction and other coal chemistry has not been approached as extensively from a chemical point of view.

Coal liquefaction processes are predicated on controlled heating of coal in the absence of oxygen to convert coal into liquid hydrocarbons, gas and ash. Some processes use an H-donor solvent to solubilize the coal at elevated temperatures. Typical H-donor solvents are aromatic compounds, e.g., phenanthrene, dihydrophenanthrene and tetralins. Optionally, a liquefaction catalyst, e.g., cobalt molybdate, may also be added to accelerate the liquefaction process. Some prior art processes (e.g., Chen et al, U.S. Pat. No. 4,247,384) combine coal with other carbonaceous materials, e.g., wood, cellulose, plants and/or peat. However, in such prior art processes the use of carbonaceous materials other than coal appears to be incidental to the process and the relative proportions of coal and other materials are not specified. Similarly, Pyzel, British Pat. No. 173,907, discloses a process for distilling bituminous materials optionally mixed with other solids, e.g., sand, sawdust, powdered coal. This process appears to be dissimilar from a coal liquefaction process. Pyzel simply distills the starting material to obtain oils, gas and coke. Relative proportions of coal and the other solids are not specified.

SUMMARY OF THE INVENTION

In accordance with the present invention, a coal liquefaction process is improved by adding to coal, preferably during the solubilization stage of liquefaction, a limited amount of lignin. The addition of lignin accelerates coal liquefaction under the conditions of liquefaction, and increases the amount of the coal converted to liquid hydrocarbons. The use of lignin is advantageous insofar as it is a relatively inexpensive raw material available in large quantities.

In an alternative embodiment of the invention, lignin is added to the feed of a resid upgrading process to increase the yield of soluble products obtained in the process.

BRIEF DESCRIPTION OF THE FIGURE

The FIGURE is a schematic representation of a typical apparatus arrangement used in coal liquefaction.

DETAILED DESCRIPTION OF THE INVENTION

The type of coal used in the coal liquefaction embodiment of the invention is not critical. Preferably, the coal is bituminous or sub-bituminous coal.

The coal liquefaction embodiment of this invention comprises a coal liquefaction process with a number of stages. A relatively small amount of lignin is added to one or more stages of the process. The liquefaction process comprises: a mixer wherein the coal is mixed with an optional H-donor solvent; a preheater to which the coal is transferred from the mixer; a dissolver receiving the preheated coal wherein the solubilization reaction takes place; and, a separator where light hydrocarbons are separated from coal extract, deashed coal, undissolved coal and ash. Optionally, a coal liquefaction catalyst and make-up hydrogen may be added to the dissolver. A portion of the light hydrocarbons from the separator may also be recycled to the dissolver. The use of an H-donor solvent in this embodiment is also optional. The term H-donor solvent, as it relates to liquefaction of coal, typically refers to phenanthrene, dihydrophenanthrene, tetralins, hydropyrenes or mixtures thereof. Each of these H-donor solvents may be produced in the coal liquefaction process. Each solvent may be contained in the coal extract separated from ash, deashed coal and undissolved coal, which are separated in a conventional separator at the end of the process. Accordingly, the coal extract produced in the process can be the H-donor solvent. In accordance with the invention at least a portion of coal extract leaving the separator can be recycled, as H-donor solvent, to the mixer. The weight ratio of H-donor solvent, when used, to coal is about 0.5 to about 5.

The lignin may be added in this embodiment at any point in the process up to and including the dissolver stage, but is preferably added to the coal not later than the preheating stage. The amount of lignin added to the coal is about 1.0 to about 4.0%, preferably about 1.1 to about 4.0% and most preferably 1.1 to about 2.0% based on the weight of the coal.

Lignin is the second most abundant polymeric organic product occurring in nature. The building blocks of lignin are coniferyl alcohol and synapyl alcohol which contain one and two unsubstituted or substituted methoxy groups, respectively, on the phenolic (aryl ether) ring, as disclosed by H. Nimz, Angew. Chem. Inter. Ed. Vol. 13/No. 5 (1974), the entire contents of which are incorporated herein by reference. Accordingly, lignin can be described as a source of recurring units of the phenolic moiety, and represents an inexpensive reagent to produce by decomposition a source of compounds, oligomers or polymers, containing phenolic hydroxy groups and/or a source of ethers which upon thermal treatment yield said compounds.

Liquefaction of coal can simply be described as involving the thermal rupturing of linkages creating the primary products of greatest interest. Without wishing to be bound by any theory of operability, the decomposition of lignin in the dissolution stage is believed to accelerate the liquefaction of coal by generating free radicals, by a hydrogen-donor function and/or simply by solvation. The only known analogy to the instant invention is the use of phenols to enhance the rate of the decomposition of di-2-naphthyl ether at 450° C., reported by T. Yao and Y. Kamiya in Bull. Chem. Soc. Japan, 52 (29), 492 (1979). Accordingly, it is further believed that the decomposition of lignin will accelerate the thermal decomposition of ether group-containing components of coal.

The lignin decomposes during liquefaction to accelerate coal liquefaction, and to increase the amount of liquefied product obtained in the process. The addition of the aforementioned amount of lignin to the coal liquefaction process can increase the yield of solubles in the product, e.g., as measured by the amount of product soluble in tetrahydrofuran (THF), by as much as 90%, with little impact on coal conversion.

In the dissolution, or solubilization stage, the temperature ranges from about 600° F. to about 1000° F. The pressure in the dissolver ranges from about 50 to about 3000 psig. Residence time in the dissolver ranges from about 0.5 to about 180 minutes. The hydrogen, which is optionally but preferably used in the liquefaction stage, can vary in flow rate from 500 standard cubic feet per barrel (scf/bbl) to 5000 scf/bbl in excess of the amount consumed. Any conventional liquefaction catalyst, for instance cobalt molybdate, may be optionally added to the dissolver stage, although no catalyst is used when the liquefaction is a thermal liquefaction undertaken with short dissolver residence times.

In the alternative embodiment, a relatively small amount of lignin is added to the feed of a resid processing operation. The term "resid" as used in the specification and the appended claims means heavy petroliferous stocks, such as vacuum and atomospheric resids, tar sand oils, shale oils, liquids from conversion of coal and similar materials. Such materials usually contain a substantial amount of sulfur, nitrogen and metal contaminants. The lignin is added to the resid in the amount of about 0.01 to about 10%, preferably about 0.5 to about 5% by weight, based on the weight of the resid. In this embodiment, the lignin also increases the amount of the valuable liquid hydrocarbon product obtained from the resid processing, e.g., as measured by the percentage of the product soluble in tetrahydrofuran (THF). The term "resid processing" as used herein, comprises a conventional, usually catalytic, reaction in which heavy hydrocarbon stocks, or resids as defined above, are converted to such premium products as motor gasoline, diesel fuel, jet fuel, distillate fuel and kerosene. The process, which may first involve hydrotreating in the presence of hydrogen and a hydrotreating catalyst to remove nitrogen and sulfur, usually involves passing the hydrotreated feed over a hydrocracking catalyst in the presence of hydrogen. The details of the resid processing process are disclosed, e.g., in U.S. Pat. Nos. 4,152,250; 4,191,636; 4,194,964; and 4,289,605; the entire contents of all of which are incorporated herein by reference.

The process conditions of resid processing are similar to the coal liquefaction process, namely temperature of about 600° F. to about 1000° F., preferably about 750° F. to about 950° F.; pressure of about 50 to about 3500 psig; and hydrogen flow rate of about 3,000 to about 15,000 scf/bbl. The lignin may be added in resid processing to the feed into the hydrotreating step or to the effluent of the hydrotreating step before the effluent is conducted to the hydrocracking step. Preferably, however, the lignin is added to the effluent of the hydrotreating step.

The coal liquefaction embodiment of this invention will now be described in conjunction with the schematic process shown in the FIGURE.

In the FIGURE, coal can be admixed, optionally, with the H-donor solvent and passed to the preheater 3. From the preheater 3 the coal travels to the dissolver 4.

The lignin, used in accordance with the invention, can be added to the coal in the mixer 1, in the preheater 3 and/or in the dissolver 4. Preferably, however, the lignin is added to the system and to the coal not later than the preheating stage undertaken in the preheater 3.

After solubilization, the treated coal travels to separator 6, optionally through a cooler 5. In separator 6, the light hydrocarbons produced during liquefaction distill out and are trapped in drop-out pot 7. The mixture of ash; undissolved coal; deashed coal and coal extract; leaving the separator can be processed according to known techniques. For example, a part of the coal extract of the mixture which can be flashed off can be recycled to the mixer 1 as the H-donor solvent.

The dissolver 4 may be a part of a gas loop, receiving recycle gases from drop-out pot 7, and/or providing a means by which make-up hydrogen can be introduced into the dissolver 4. In addition, the dissolver may be part of the recycle loop through which catalyst may be added.

The following examples illustrate the applicability of this invention to the coal liquefaction process and to resid processing.

EXAMPLE 1

In this example, Belle Ayr Coal (a western subbituminous coal comprising, by weight on a moisture ash-free basis: 72.2% carbon; 5.65% hydrogen; 20.56% oxygen; 1.19% nitrogen; 0.40% sulfur; and 4.5% ash) was used to demonstrate the effect of lignin on coal liquefaction process. In the control sample, the coal was mixed with a low hydrogen content (8.15% by weight hydrogen), 400° F.–800° F. boiling point (BP) H-donor solvent. The ratio of the coal to the solvent was 1:3 by weight. The mixture was then subjected to coal liquefaction conditions, in a conventional shaker bomb apparatus. The process conditions are summarized in Table 1 below.

Two similar mixtures of the Belle Ayr coal and the same solvent as the one used above, also having the coal:solvent ratio of 1:3, were then prepared. To the first mixture (16 grams) there was added 1% by weight of lignin, while to the second mixture (16 grams) 10% by weight of lignin. Both mixtures were then subjected to the same coal liquefaction conditions as the control sample. Test results are summarized in Table 1 below.

TABLE 1

| | Coal Conversion | % of Converted Coal which is 400+° F.; THF* soluble |
|---|---|---|
| Control Sample | 71.8% | 38.5% |
| Mixture 1 - 1% Lignin | 68.4% | 73.2% |
| Mixture 2 - 10% Lignin | 59.1% | 19% |

All runs conducted at 800° F., 1000 psig $H_2$ pressure for 6 minutes.

*Tetrahydrofuran

The results of Table 1 indicate that 1% lignin substantially improves selectivity of the process to liquid products with only a minor impact on coal conversion. Surprisingly, the addition of 10% lignin has a detrimental effect on the selectivity and a substantial negative impact on coal conversion.

EXAMPLE 2

In this example, arab light vacuum resid was used to demonstrate the effect of lignin or resid processing. In run number 1, the control sample, resid was processed in a conventional manner with no lignin. In run number 2, approximately 10% by weight of lignin was added to the resid. Both runs were conducted in a conventional shaker bomb apparatus under the same conditions set forth in Table 2 below. The composition of the Arab Light Vacuum Resid used in this example is: carbon=85.40%; hydrogen=10.10%; oxygen=0.30%; nitrogen=0.20%; sulfur-4.0%; ash=0.0%; all percentages by weight.

TABLE 2

| Run No. | 1 | 2 |
|---|---|---|
| Reactants | | |
| Arab Lt. Vac. Resid | 8.28 grams | 8.46 grams |
| Lignin | — | 0.80 grams |
| Conditions | | |
| H2 Pressure | 1000 psig | 1000 psig |
| Temp. °F. | 840° F. | 840° F. |
| Time minutes | 40 | 40 |
| Product Distribution | | |
| THF insolubles, grams | 1.008 g | 1.086 g |
| THF insolubles as % of total feed | 12.2% | 11.7% |
| THF insolubles as % of ALVR* feed | 12.2% | 12.8% |
| THF solubles, grams | 4.71 g (81%) | 5.29 g (83%) |

*Arab Light Vacuum Residue

The data of Table 2 demonstrates that a higher yield of THF solubles is obtained as a percentage of original reactants in run 2 using 10% of lignin, with no significant changes in other product properties.

It will be apparent to those skilled in the art that the above examples can be successfully repeated with ingredients equivalent to those generically or specifically set forth above and under variable process conditions.

From the foregoing specification one skilled in the art can readily ascertain the essential features of this invention and without departing from the spirit and scope thereof can adopt it to various diverse applications.

What is claimed is:

1. A process for the liquefaction of coal comprising admixing the coal to be subjected to liquefaction with about 1.0% to about 4.0% of lignin based on the weight of the coal; introducing the mixture of coal and lignin to a dissolver wherein said mixture is subjected to temperature of about 600° F. to about 800° F. and pressure of about 50 to about 3000 psig for a period of time ranging from 0.5 to 180 minutes; and, separating light hydrocarbon fractions from a mixture of ash, undissolved coal, deashed coal and high quality coal extracts.

2. The process of claim 1, wherein said mixture is maintained in the dissolver in the presence of hydrogen.

3. The process of claim 1, wherein the mixture contains phenanthrene, dihydrophenanthrene, tetralins, hydropyrenes or mixtures thereof.

4. The process of claim 1, wherein the mixture contains a high quality coal extract, obtained by recycling at least a portion of the high quality coal extracts.

5. The process of claim 1 wherein the mixture consists essentially of said coal and said lignin.

6. The process of claim 1, wherein a liquefaction catalyst is added to the mixture in the dissolver.

7. The process of claim 6, wherein said catalyst is cobalt molybdate.

8. The process of claim 1, wherein the light hydrocarbon fractions are recycled into the dissolver.

9. The process of claims 2, 3, 4, 5, 6, 7 or 8 wherein the coal is admixed with about 1.1 to about 2.0% of lignin based on the weight of the coal.

10. In a resid processing method, comprising hydrotreating a resid and then hydrocracking the hydrotreated resid, an improvement comprising adding to the resid about 0.01 to about 10% by weight, based on the weight of the resid, of lignin.

11. A method according to claim 10 wherein the amount of the lignin added to the resid is about 0.5 to about 5% by weight, based on the weight of the resid.

12. In a resid processing method comprising hydrocracking the resid, an improvement comprising adding to the resid about 0.01% to about 10% by weight, based on the weight of the resid, of lignin.

13. A method according to claim 10 wherein the amount of the lignin added to the resid is about 0.5 to about 5% by weight, based on the weight of the resid.

* * * * *